United States Patent [19]

Perfect

[11] 4,062,677

[45] Dec. 13, 1977

[54] TUNGSTEN-TITANIUM-ALUMINUM MASTER ALLOY

[75] Inventor: Frederick H. Perfect, Wyomissing, Pa.

[73] Assignee: Reading Alloys, Inc., Robesonia, Pa.; a part interest

[21] Appl. No.: 723,933

[22] Filed: Sept. 16, 1976

[51] Int. Cl.[2] ..... C22C 27/04

[52] U.S. Cl. ..... 75/176

[58] Field of Search ..... 75/134 F, 138, 175.5, 75/176

[56] References Cited

U.S. PATENT DOCUMENTS

| | | | |
|---|---|---|---|
| 1,833,076 | 11/1931 | Haglund | 75/138 |
| 3,725,054 | 4/1973 | Perfect | 75/138 |

OTHER PUBLICATIONS

*Titanium Abstract Bulletin*, Abstract No. 4974, Imperial Chemical Industries vol. 4, No. 6, (1959) pp. 198–199.

*Primary Examiner*—L. Dewayne Rutledge
*Assistant Examiner*—Michael L. Lewis
*Attorney, Agent, or Firm*—Howson and Howson

[57] ABSTRACT

The invention relates to master alloys containing about 55 to about 70% tungsten, about 2 to about 10% titanium, balance substantially aluminum.

2 Claims, No Drawings

TUNGSTEN-TITANIUM-ALUMINUM MASTER ALLOY

DESCRIPTION OF THE INVENTION

Master alloys are widely used in the production of titanium base alloys. Advantageously, master alloys used for this purpose are easily melted and combine uniformly with titanium base metal.

Early attempts to prepare approximately 50—50 aluminum-tungsten alloys proved unsuccessful since a portion of ingots prepared from such material was ductile while the remaining lower portion of the ingot was brittle. Analysis established that such ingots were not homogenous throughout, the ductile upper portion thereof containing substantially more aluminum than tungsten, and the brittle lower portion of the ingot containing substantially more tungsten than aluminum.

It is an object of this invention to provide a tungsten-titanium-aluminum master alloy for use in the manufacture of titanium base alloys which is of uniform, homogenous composition, relatively low melting, and of high purity.

The present invention provides master alloys comprising from about 55 to about 70% tungsten, about 2 to about 10% titanium, balance substantially aluminum, suitable for use in making titanium-base alloys.

The master alloys are produced by the aluminothermic reduction of tungsten trioxide ($WO_3$) or calcium tungstate and titanium dioxide with excess aluminum thereby effecting reduction of the oxides to metallic tungsten and titanium which combines with excess aluminum forming the desired master alloy. It has been found that master alloys containing about 55 to about 70% tungsten, about 2 to about 10% titanium, balance substantially aluminum, said percentage being by weight, based on the weight of the master alloy are homogenous, friable, substantially free of slag and can be readily sized for mixture with titanium sponge in the manufacture of tungsten containing titanium base alloys.

The master alloys of this invention may be produced in any suitable apparatus. A preferred type of reaction vessel is a water-cooled copper vessel of the type described in "Metallothermic Reduction of Oxides in Water-Cooled Copper Furnaces", by F. H. Perfect, Transactions of the Metallurgical Society of AIME, Vol. 239, August 67, pp. 1282–1286.

In producing the master alloys of this invention, tungsten trioxide or calcium tungstate, titanium dioxide and aluminum may be reduced to relatively small size, and intimately mixed so that the reaction will occur rapidly and uniformly throughout the charge on ignition. An excess of aluminum is used to produce alloys of the metals tungsten, titanium and aluminum. Ignition of the reaction mixture may be effected by heating the charge above the melting point of aluminum by an electric arc, gas burners, hot metal bar, wire or the like.

Relatively pure Sheelite (calcium wolframate, $CaWO_4$), which normally analyzes about 80% $WO_3$, is used as the source of tungsten. Other useful sources of $WO_3$ include commercial wolfram oxide.

It is preferred to use pigment grade titanium dioxide which analyzes 99+% $TiO_2$ as the source of titanium. However, less pure $TiO_2$-containing material, such as native rutile, which analyzes about 96% $TiO_2$, and contains minor amounts of the oxides of Fe, Si, Zr, Cr, Al and Ca, as well as S and P, as impurities, may also be employed. Commercial grade $TiO_2$ is preferable since its use enhances the purity of the resulting master alloy.

The aluminum powder should be of the highest purity available commercially. Virgin aluminum powder, analyzing in excess of 99% aluminum, is the preferred reducing agent and addition agent.

Due to natural variance in purity of the metal oxides and aluminum reactants, the proportion of the constituents required to provide master alloys of the desired composition will vary. For this reason, the respective amounts of reactants used are expressed in terms of the composition of the desired master alloy in the present specification and claims. As stated above, the amounts of the reactants should be so proportioned as to provide master alloys containing from about 55 to about 70% tungsten, about 2 to about 10% titanium, balance substantially aluminum. A particularly preferred master alloy contains about 68% tungsten, 7% titanium, balance aluminum.

A calcium aluminate slag is produced during the reaction, and the reaction is carried out in the presence of a molten flux which dilutes the slag and renders it more fluid in order that the slag may be separated from the alloy. The flux must be capable of diluting the slag formed by the reaction to produce a less viscous slag which separates readily from the alloy. The fluorides and chlorides of metals such as Ca, Na, Al and K, alone or in combination with other inorganic materials, are particularly suitable for forming slag-absorbing fluxes.

The amount of flux-forming agents employed should be sufficient to provide an amount of molten flux capable of diluting the slag formed during oxide reduction to provide a less viscous slag which is readily separated from the metal. Preferably, an excess of flux over that needed to obtain the desired reduction in slag viscosity is used. The excess may be from about 0.5 to 2 times the weight of the slag formed in the process.

The resulting tungsten-titanium-aluminum master alloys are homogenous, and relatively void free. In addition, the master alloys of this invention are easily cleaned since the surface is almost free of non-metallics.

To form titanium base alloys from the tungsten-titanium-aluminum-master alloys, the alloys are suitably sized to ¼ inch by 50 mesh and blended with titanium sponge in sufficient amounts to provide the desired titanium base alloy.

The following examples are illustrative of the invention:

EXAMPLE 1

The materials shown in Table I were combined and mixed together:

Table I

| Ingredient: | Weight (lbs.) |
|---|---|
| $CaWO_4$ | 98.5 |
| $TiO_2$ (pigment grade) | 12.5 |
| Al | 67 |
| $CaF_2$ | 5 |
| $NaClO_3$ | 20 |

After mixing, one-fourth of the charge was placed in a crucible. The charge was ignited and ran for approximately 10 seconds. The resulting alloy weighed 23 lbs. The ingot was uniform throughout and easily crushed. The analysis of the alloy is in Table II.

Table II

| | Percent |
|---|---|
| W | 61.33 |
| Ti | 6.04 |
| Al | 28.73 |
| $O_2$ | 0.06 |

EXAMPLE 2

Following the procedure of Example 1, an alloy was prepared from the mixture shown in Table III.

Table III

| Ingredient | Weight (lbs.) |
|---|---|
| $CaWO_4$ | 98.5 |
| $TiO_2$ (pigment grade) | 25 |
| Al | 65 |
| $CaF_2$ | 8 |
| $NaClO_3$ | 20 |

After mixing, one-fourth of the mixture was ignited and ran for 8 seconds, the ingot produced weighing 24.5 lbs. The resulting alloy has the analysis shown in Table IV.

Table IV

| | Percent |
|---|---|
| W | 62.04 |
| Ti | 7.88 |
| Al | 24.84 |
| $O_2$ | 0.09 |

EXAMPLE 3

Following the procedure of Example 1, an alloy was prepared from the mixture shown in Table V.

Table V

| Ingredient | Weight (lbs.) |
|---|---|
| $CaWO_4$ | 102 |
| $TiO_2$ | 17 |
| Al | 58 |
| $CaF_2$ | 5 |
| $NaClO_3$ | 10 |

After mixing, the charge was placed in a water cooled copper furnace, ignited and ran for 39 seconds, the ingot produced weighing 92 lbs. The resulting alloy has the analysis shown in Table VI.

Table VI

| | Percent |
|---|---|
| W | 68.75 |
| Ti | 7.06 |
| Al | 23.78 |
| $O_2$ | 0.11 |
| S | 0.002 |
| Fe | 0.24 |
| C | 0.055 |
| N | 0.005 |

Having thus described the invention, what is claimed is:

1. A tungsten-titanium-aluminum master alloy for use in making titanium base alloys comprising from about 55 to about 70% tungsten, about 2 to about 10% titanium, balance substantially aluminum.

2. The master alloy of claim 1 consisting essentially of about 68% tungsten, about 7% titanium, balance aluminum.

* * * * *